United States Patent [19]

Locher

[11] Patent Number: 4,684,173

[45] Date of Patent: Aug. 4, 1987

[54] CHAIR WITH REARWARDLY INCLINABLE SEAT AND BACK REST CARRIER

[75] Inventor: Hermann Locher, Dornach, Switzerland

[73] Assignee: Giroflex Entwicklungs AG, Koblenz, Switzerland

[21] Appl. No.: 780,825

[22] Filed: Sep. 27, 1985

[30] Foreign Application Priority Data

Oct. 3, 1984 [CH] Switzerland ..... 04760/84

[51] Int. Cl.[4] ..... A47C 3/00

[52] U.S. Cl. ..... 297/300; 297/301

[58] Field of Search ..... 297/300, 301, 316, 320

[56] References Cited

U.S. PATENT DOCUMENTS

| | | | |
|---|---|---|---|
| 3,989,297 | 11/1976 | Kerstholt | 297/300 |
| 4,143,910 | 3/1979 | Geffers et al. | 297/301 |
| 4,411,469 | 10/1983 | Drabert et al. | 297/300 |
| 4,432,582 | 2/1984 | Wiesmann et al. | 297/300 X |
| 4,471,994 | 9/1984 | Züno et al. | 297/300 |
| 4,479,679 | 10/1984 | Fries et al. | 297/300 |
| 4,502,729 | 3/1985 | Locher | 297/300 X |
| 4,537,445 | 8/1985 | Neuhoff | 297/300 |

FOREIGN PATENT DOCUMENTS

| | | | |
|---|---|---|---|
| 2757349 | 5/1979 | Fed. Rep. of Germany | 297/300 |
| 2846360 | 8/1980 | Fed. Rep. of Germany | 297/300 |

*Primary Examiner*—Peter A. Aschenbrenner
*Attorney, Agent, or Firm*—Werner W. Kleeman

[57] ABSTRACT

A seat carrier and a back rest carrier are linked by pivot joints through a lever to a carrying or swivelling component. At the end of the seat carrier on the back rest side there is connected a chain of link members which at its other end is connected to a slide and a back rest. When the chair inclines towards the rear, the chain of link members causes the slide and the back rest to conjointly move in a downwards direction. The so-called undressing effect caused by the change-over from the normal position into the rearwardly inclined position of the back rest is eliminated in a simple and space saving manner and without exploiting the space below the seat carrier. By arranging a spring element, for instance a gas spring, in the knee region of the chair, ready access can be had to the spring element for arresting it.

20 Claims, 4 Drawing Figures

CHAIR WITH REARWARDLY INCLINABLE SEAT AND BACK REST CARRIER

CROSS REFERENCES TO RELATED PATENT AND PATENT APPLICATION

This application is related to my U.S. Pat. No. 4,502,729, granted March 5, 1985 and entitled "Chair, Especially a Reclining Chair".

This application is also related to my commonly assigned, copending U.S. patent application Ser. No. 652,496, filed Sept. 19, 1984 and entitled "Chair with Swivelling Seat and Back Rest Portions".

BACKGROUND OF THE INVENTION

The present invention relates to an article of furniture and, more specifically, pertains to a new and improved construction of an adjustable chair or seating structure.

In general, the present invention concerns a chair with rearwardly inclinable seat and back rest carriers. The rearwardly inclinable seat carrier is arranged to pivot at its knee side or front portion about a seat support means or swivelling component or chair base by means of a knee or front pivot joint having a horizontal axis. At its end on the back rear side or rear end, the rearwardly inclinable seat carrier is pivotably connected with the back rest carrier by means of a back rest or rear pivot joint having a horizontal axis. The back rest carrier is linked about a substantially horizontal pivot axis to the seat support means or swivelling component or chair base in a spaced relationship to the knee or front pivot joint of the seat carrier. When the seat carrier inclines rearwardly, the back rest carrier inclines at a greater angle than the inclination angle of the seat carrier. A back rest, guided on the back rest carrier, is displaced downwardly by a distance determined by the inclination of the seat carrier.

Generally speaking, the present invention also comprises a chair frame associated with a chair of the above-mentioned type.

Prior art chairs with rearwardly inclinable seat carriers and back rest carriers are known in various executions. In a simple known construction, the seat carrier and the back rest carrier are each pivotably linked at one end to a carrying or swivelling component to pivot about substantially horizontal pivot axes disposed in mutually spaced relationship. The seat portion is connected at its other end through a pivot joint with the back rest carrier. During a rearward inclination of the seat portion, the back rest carrier inclines at a greater angle than the seat portion or seat carrier. For this purpose, either an additional connecting strut is associated with one of the pivot joints or one of the pivot joints is designed as a sliding joint. The greater inclination of the back rest carrier brings about the well-known undressing effect, i.e. the clothing of the chair user is pulled upwards during the rearward inclination of the chair.

To prevent the undressing effect, it is known (cf. PCT published patent application No. WO 83/00610) to arrange a back rest to the back rest carrier which is displaceable in height and which, upon rearward inclination of the seat carrier, is moved downwards a distance corresponding to the inclination of the seat carrier, so that no undressing effect occurs.

The automatically occurring displacement of the back rest in dependence of the rearward inclination of the seat carrier is achieved by means of a linkage which is linked or hingedly connected to the pivot joint of the back rest carrier at the carrying or swivelling component side thereof. This linkage requires a comparatively large amount of space, and since it is situated under the seat surface and extends up to the end of the chair at the knee side, is not only space-consuming but also expensive.

SUMMARY OF THE INVENTION

Therefore, with the foregoing in mind it is a primary object of the present invention to provide a new and improved chair construction which reduces or eliminates the undressing effect and achieves a noticeable increase of comfort for the chair user without requiring the user to forgo a displaceable back rest.

Another important object of the invention is to develop a chair of the above-mentioned type in which a reduction or elimination of the undressing effect can be achieved by means which are simple and which take up less space.

Now in order to implement these and still further objects of the invention, which will become more readily apparent as the description proceeds, the chair with rearwardly inclinable seat and back rest carriers is manifested by the features that the displaceable back rest is connected with the end of the seat carrier at the rear side or end thereof by means of a linkage or chain of link members.

This has the effect that the space under the seating surface remains free of components for displacing the back rest, while due to the smaller distance between the connection point and the back rest, the link members or elements of the linkage or chain of link members can be of small configuration.

The invention also includes in a broader sense a chair frame which is particularly but not exclusively suitable for the inventive chair. This chair frame is manifested by the features that a lever means is associated with the back rest carrier. This lever means is linked to a pivot joint of the seat support means or swivelling component. The free end of the lever means serves as a first support mount for a spring means, whereas the other support mount of the spring means is linked to a pivot joint at the seat support means or swivelling component side of the seat carrier or is, alternatively, arranged near the seat carrier in the seat support means or swivelling component.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components. All the figures of the drawings depict kinematic rigid body diagrams of a chair or chair frame. Therefore the various arts are illustrated only once although, depending on the constructive design, they may occur only once or more often. Reference here is made to the above-mentioned PCT published patent application No. WO 83/00610, especially FIGS. 3 to 5 and also to the European published Patent Application No. BE 20 729, especially FIGS. 2 to 4. In the Figures.

DETAILED OF THE PREFERRED EMBODIMENTS

Figure 1:
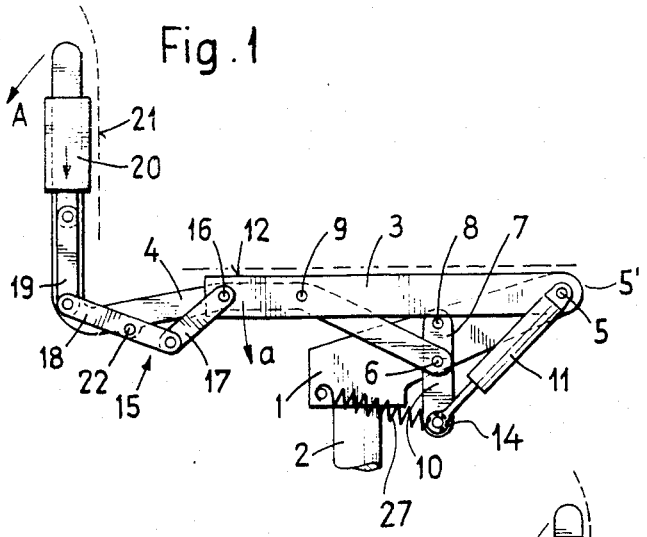
FIG. 1 schematically shows a rearwardly inclinable chair (or its kinematic rigid body diagram) with displaceable back rest.

Describing now the drawings, it is to be understood that to simplify the showing thereof, only enough of the structure of the exemplary embodiments of the chair with rearwardly inclinable seat and back rest carriers has been illustrated therein as is needed to enable one skilled in the art to readily understand the underlying principles and concepts of this present invention. Turning now specifically to FIG. 1 of the drawings, the chair depicted by way of example and not limitation therein will be seen to be supported on a seat support means or swivelling component or chair base 1 which represents a part of a supporting shaft or foot stand 2 which is normally mobile, i.e. wheeled, and which is only partly depicted in FIG. 1. A seat carrier 3 and a back rest carrier 4 are mounted on the seat support means or swivelling component 1. The seat carrier 3, at its end on the knee side, i.e. the front region of the chair in the vicinity of the occupant's knees, is pivotably mounted to the seat support means or swivelling component 1 by means of a front or knee pivot joint 5. The back rest carrier 4 is hinged to a swing link or lever 7 by means of a lower pivot joint 6. The lever 7 is in turn pivotably mounted in the seat support means or swivelling component 1 by means of a further seat support means or swivelling component pivot joint 8 in spaced relationship to the front or knee pivot joint 5 of the seat carrier 3.

All the pivot joints described hereinbelow as well as the pivot joints 5, 6 and 8 already described hereinabove are arranged with substantially horizontal pivot axes. In the further description, this fact will not be particularly mentioned again.

The seat carrier 3 and the back rest carrier 4 are, at their rear ends or ends on the back rest side, i.e. the rear region of the chair in the vicinity of the back rest, pivotably connected to one another by means of a rear or back rest pivot joint 9. The lever 7 is constructed as a lever having a fulcrum at the seat support means or swivelling component pivot joint 8 and two further pivot joints, namely the lower pivot joint 6 and a lowermost pivot joint 14. A first eye or end of a spring means or element 11 is supported from an outer lever arm portion 10 of the lever 7 at the lowermost pivot joint 14. A second eye or end of the spring means or element 11 is supported on the seat support means or swivelling component 1. This second eye or end is hinged to the seat support means or swivelling component 1 at the front or knee side pivot joint 5 of the seat carrier 3 or near to this front or knee side pivot joint 5. If the back rest component 4 moves by a certain distance or amount, then this distance or amount will be increased at the free end of the outer lever arm portion 10, so that the spring travel or deflection of the spring means or element 11 will be correspondingly increased or multiplied. A further spring means, such as a torsion spring 5', may be arranged in the front or knee pivot joint 5.

An extension 12 of the seat carrier 3 projects beyond the back rest pivot joint 9. A linkage or chain of link members 15 is connected to the free end of this extension 12 by means of a link pivot joint 16. The linkage or chain of link members 15 is composed of three link members or elements—a first link member or element 17, a second or middle link member or element 18 and a third link member or element 19. These link members or elements 17, 18 and 19 are pivotably interconnected. The second or middle link member or element 18 defines a double-armed lever or rocking lever having its pivot point or fulcrum on the rearwardly inclinable back rest carrier means 4 at a middle pivot joint 22. The third link member or element 19 is connected at its free end with a slide 20, which is guided or slides on the back rest component or carrier 4. The slide 20 carries a back rest 21 which is depicted schematically by means of a dotted line in FIG. 1.

When the chair is inclined rearwardly, the seat carrier 3 moves about the front or knee pivot joint 5 in the direction of the arrow a and the back rest carrier 4 moves about the back rest pivot joint 9 in the direction of the arrow A. The inclination of the back rest carrier 4 is greater than that of the seat carrier 3. Due to the relative movement between the seat carrier 3 and the back rest carrier 4, the linkage or chain of link members 15 is displaced such that the slide 20 moves downwardly conjointly with the back rest 21. This is achieved by pivotably mounting the second or middle link member or element 18 on the back rest carrier 4 by means of the middle pivot joint 22 serving as a fulcrum. Thus the second or middle link member or element 18 forms a double-armed lever by means of which the inclination of the first link member or element 17 is reduced during rearwardly inclination of the back rest carrier 4, thereby effecting a downward movement of the slide 20. The third link member or element 19 merely acts as a connecting rod preventing a jamming or binding of the slide 20 in its guide or slide.

In the chair according to FIG. 1, an inner portion of the lever 7 connects the back rest component 4 with the seat support means or swivelling component 1. Therefore the inner portion of the lever 7 which lies between the lower pivot joint 6 and the seat support means or swivelling component pivot joint 8 is in fact a strut, i.e. a radius link or swing arm, which makes possible the rearward inclination of the two carriers 3 and 4 without jamming or binding and without requiring one of the pivot joints to be constructed as an additional slide joint.

From FIG. 1 there can further be seen the space-saving and simple solution of the displacement of the slide 20 conjointly with the back rest 21. The space available underneath the seat carrier 3 can be employed for other components. The effect, i.e. the force, of the spring means or element 11 is also increased or multiplied through the use of the lever 7, since this diminishes the movement of the back rest carrier 4 relative to the spring element 11, i.e. provides a mechanical advantage.

Figure 2:
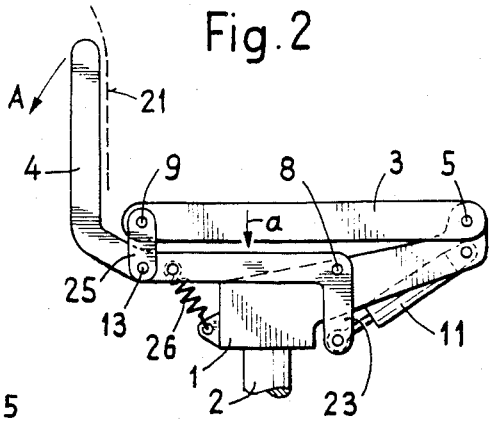
FIG. 2 schematically shows a first modified embodiment of the chair frame of the chair of FIG. 1.
Figure 3:
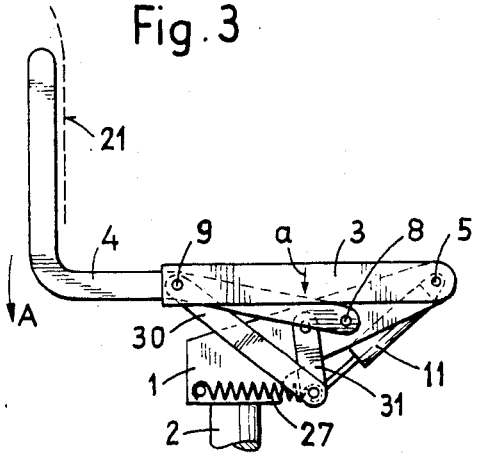
FIG. 3 schematically shows a second modified embodiment of the chair frame of the chair of FIG. 1.
Figure 4:
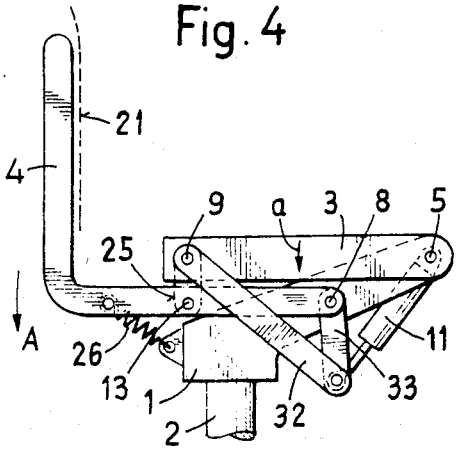
FIG. 4 schematically shows a third modified embodiment of the chair frame of the chair of FIG. 1.

In FIGS. 2 through 4 only chair frames are depicted, i.e. chairs without linkages or chains of link members 15 and slides 20. It is of course also possible to fit the linkage or chain of link members 15 with the slide 20 to any of these chair frames and thereby to eliminate the undressing effect in these exemplary embodiments also. The exemplary embodiments in FIGS. 1 to 4 also show that free space can be gained under the seat carrier 3 if no linkage for displacing the back rest 21 need be arranged in the region of the seat support means or swivelling component 1, but instead a linkage or chain of link members 15 lying outside the seat carrier 3 can be utilized instead. Furthermore, FIGS. 2 through 4 show that this arrangement permits the employment of additional spring means or linkages for their actuation, as will be shown in the following.

In the chair frame according to FIG. 2 the same parts are generally referenced with the same numbers as in FIG. 1. The seat carrier 3 is mounted on the front or knee pivot joint 5 and is connected at its rear end or side near the back rest with the back rest carrier 4 by means of a strut 25 and two pivot joints, the back rest pivot joint 9 and the lower rear pivot joint 13. The back rest carrier 4 can be pivotably mounted on the seat support means or swivelling component 1 by means of the seat support means or swivelling component pivot joint 8 without a slide joint being required. In this regard, the back rest carrier 4 possesses a cantilever arm 23 which extends or cantilevers beyond the seat support means or swivelling component pivot joint 8 and at whose free end the spring means or element 11 is supported. Further spring means are attached to the back rest carrier 4 near the back rest, e.g. a tension spring element 26 which is fixed at one end to the back rest carrier 4 and at the other end to the seat support means or swivelling component 1. Should still further spring means be required, then it is possible to arrange a torsion spring 5' in the front or knee pivot joint 5 of the seat carrier 3 and in the seat support means or swivelling component pivot joint 8.

In the here depicted exemplary embodiments of the chair and the chair frame the spring means always have the object of moving the chair, when it is released, back into the normal or active working position. It is also desirable to be able to actuate spring means such as the spring means or element 11, especially a gas pressure spring, arranged in the knee area so that the chair may be blocked or arrested in a predetermined position, e.g. in its rearwardly inclined position. This operation or actuation of the spring means can be designed to be readily accessible due to the location of the spring means.

In the chair frame shown in FIG. 3, one end of the spring element or means 11 is conjointly supported by a pair of struts 30 and 31. The strut 30 is supported on the back rest pivot joint 9 of the seat carrier 3 and the back rest carrier 4 and the strut 31 is supported on the seat support means or swivelling component 1. It is possible to vary the spring travel or deflection of the spring element or means 11 by means of the pair of struts 30 and 31. A further spring means, such as a tension spring 27, is also supported at one end on the strut pair 30, 31 and at its other end on the seat support means or swivelling component 1.

In the chair frame shown in FIG. 4, the seat carrier 3 and the back rest carrier 4 are connected with each other at their ends near the back rest by means of strut 25 and are also pivotably mounted on the seat support means or swivelling component 1 by means of the pivot joints 5 and 8. A pair of struts 32 and 33 is provided for one support of the spring means or element 11. The strut 32 is pivotably mounted on the back rest pivot joint 9 of the seat carrier 3 and the strut 33 is pivotably mounted on the seat support means or swivelling component pivot joint 8 of the back rest carrier 4 in the seat support means or swivelling element 1.

It is of course possible to also provide a torsion spring 5' in the chair frame according to FIGS. 3 and 4 and also of FIG. 1 at the knee pivot joint 5 of the seat carrier 3. In the chair frames of FIGS. 2, 3 and 4 such a torsion spring could also be provided at the carrying component pivot joint 8 of the back rest component or carrier 4.

While there are shown and described present preferred embodiments of the invention, it is to be distinctly understood that the invention is not limited thereto, but may be otherwise variously embodied and practiced within the scope of the following claims.

Accordingly, What I claim is:

1. A reclining chair, comprising:

seat support means including means defining a first substantially horizontal pivot axis and a second substantially horizontal pivot axis extending in mutually spaced relationship;

rearwardly inclinable seat carrier means pivotable about said first substantially horizontal pivot axis and having a rear end;

rearwardly inclinable back rest carrier means pivotable relative to said second substantially horizontal pivot axis and having a back rest region;

means coupling said rearwardly inclinable seat carrier means to said rearwardly inclinable back rest carrier means such that rearward inclinations of said rearwardly inclinable seat carrier means and of said rearwardly inclinable back rest carrier means occur conjointly and such that an ensuing downward motion of said rear end is less than an ensuing downward motion of said back rest region;

back rest means translatably guided on said rearwardly inclinable back rest carrier means; and linkage means interconnecting said rear end of said rearwardly inclinable seat carrier means, said back rest region of said rearwardly inclinable back rest carrier means and said back rest means such that said rearward inclinations cause a downward movement of said back rest means approximately equal to said downward movement of said rear edge of said rearwardly inclinable seat carrier means.

2. The chair as defined in claim 1, wherein:

said rearwardly inclinable back rest carrier means comprises a pivot joint located between said back rest and said rear end of the rearwardly inclinable seat carrier means; and a link element of said linkage means being rotatably journalled on said pivot joint.

3. The chair as defined in claim 2, wherein:

said linkage means comprises a first link member, a second link member and a third link member;

said second link member being constructed as a rocking lever having a pivot axis and defining said link element; and said second link member bring pivotably mounted about said pivot axis on said pivot joint of the rearwardly inclinable back rest carrier means.

4. The resulting chair as defined in claim 1, wherein:

said rearwardly inclinable back rest carrier means comprises middle pivot joint means located between said back rest means and said rear end of said rearwardly inclinable seat carrier means;

said linkage means comprising a second link member defining a rocking lever and having a first end, a second end and a middle pivot joint for pivotably connecting said second link member to said rearwardly inclinable back rest carrier means at said middle pivot joint means;

said linkage means comprising a first link member for pivotably connecting said first end of said second link member to said rear end of said rearwardly inclinable seat carrier means; and said linkage means comprising a third link member for pivotably connecting said second end of said second link member to said back rest means.

5. A chair frame for a reclining chair including:

seat support means including means defining a first substantially horizontal pivot axis and a second substantially horizontal pivot axis extending in mutually spaced relationship;

rearwardly inclinable seat carrier means pivotable about said first substantially horizontal pivot axis and having a rear end;

rearwardly inclinable back rest carrier means pivotable relative to said second substantially horizontal pivot axis and having a back rest region;

means coupling said rearwardly inclinable seat carrier means to said rearwardly inclinable back rest carrier means such that rearward inclinations of said rearwardly inclinable seat carrier means and of said rearwardly inclinable back rest carrier means occur conjointly and such that an ensuing downward motion of said rear end is less than an ensuing downward motion of said back rest region;

back rest means translatably guided on said rearwardly inclinable back rest carrier means;

linkage means interconnecting said rear end of said rearwardly inclinable seat carrier means, said back rest region of said rearwardly inclinable back rest carrier means and said back rest means such that said rearward inclinations cause a downward movement of said back rest means approximately equal to said downward movement of said rear edge of said rearwardly inclinable seat carrier means, wherein such chair frame comprises:

spring means for counteracting said rearward inclinations and having a first end and a second end;

means for pivotably connecting said first end of said spring means to said seat support means and lever means for pivotably connecting said second end of said spring means to said rearwardly inclinable back rest carrier means.

6. The chair frame as defined in claim 5 wherein:

said lever means comprises pivot means for pivotably linking said lever means to said rearwardly inclinable back rest carrier means.

7. The chair frame as defined in claim 5, wherein:

said rearwardly inclinable back rest carrier is connected to said lever means by a pivot joint; and said lever means being pivotably mounted on said seat support means by said means defining said second substantially horizontal pivot axis.

8. The chair frame as defined in claim 5, wherein:

said lever means comprises two pivotably connected struts each having at least one end;

a first end of said spring means being conjointly supported at said at least one end of each of said two pivotably connected struts; and at least one strut of said two pivotably connected struts being pivotably connected to said rearwardly inclinable seat carrier means.

9. The chair frame as defined in claim 5, wherein:

said lever means comprises two pivotably connected struts each having at least one end;

a first end of said spring means being conjointly supported at said at least one end of each of said two pivotably connected struts; and at least one strut of said two pivotably connected struts being pivotably connected to said rearwardly inclinable back rest carrier means.

10. The chair frame as defined in claim 8, wherein:

one strut of said two pivotably connected struts is connected to said coupling means;

said coupling means being common to both said rear end of said rearwardly inclinable seat carrier means and said rearwardly inclinable back rest carrier means; and one other strut of said two pivotably connected struts being pivotably mounted on said seat support means.

11. The chair frame as defined in claim 8, wherein:

one strut of said two pivotably connected struts is pivotably mounted on said coupling means of said rearwardly inclinable seat carrier means; and one other of said two pivotably connected struts being pivotably mounted on said means defining said second substantially horizontal pivot axis at said rearwardly inclinable back rest carrier means.

12. The chair frame as defined in claim 5, wherein:

the chair frame has an active working position and a position defining a rearward inclination; and torsion spring means provided between said means defining said first substantially horizontal axis and said seat support means for effecting a return of the chair frame from said rearward inclination into said active working position.

13. The chair frame as defined in claim 5, further including:

further spring means positioned under said rearwardly inclinable seat carrier means;

one end of said said further spring means being fixed to said seat support means; and one other end of each said further spring means being fixed to said rearwardly inclinable seat carrier means.

14. The chair frame as defined in claim 5, further including:

further spring means positioned under said rearwardly inclinable seat carrier means;

one end of each said further spring means being fixed to said seat support means; and one other end of each said further spring means being fixed to said rearwardly inclinable back rest carrier means.

15. The chair frame as defined in claim 5, further including:

further spring means positioned under said rearwardly inclinable seat carrier means;

one end of said said further spring means being fixed to said seat support means; and one other end of each said further spring means being fixed to said two pivotably connected struts.

16. The chair frame as defined in claim 5, wherein:

said rearwardly inclinable back rest carrier means comprises middle pivot joint means located between said back rest means and said rear end of said rearwardly inclinable seat carrier means;

said linkage means comprising a second link member defining a rocking lever and having a first end, a second end and a middle pivot joint for pivotably connecting said second link member to said rearwardly inclinable back rest carrier means at said middle pivot joint means;

said linkage means comprising a first link member for pivotably connecting said first end of said second link member to said rear end of said rearwardly inclinable seat carrier means; and said linkage means comprising a third link member for pivotably connecting said second end of said second link member to said back rest means.

17. The chair frame as defined in claim 5, wherein:

said lever means has a first end and a second end;

said lever means comprising first pivot means for pivotably connecting said first end to said seat support means;

said lever means comprising second pivot means for pivotably connecting said second end to said spring means; and said lever means being connected with said rearwardly inclinable back rest carrier means.

18. The chair frame as defined in claim 17, wherein:

said lever means is connected integrally with said rearwardly inclinable back rest carrier means.

19. The chair frame as defined in claim 17, wherein:

said lever means is connected directly to said rearwardly inclinable back rest carrier means by means of a pivot joint.

20. The chair frame as defined in claim 17, wherein:

said lever means is connected indirectly with said rearwardly inclinable back rest carrier means by means of an intermediate strut member.

* * * * *

UNITED STATES PATENT AND TRADEMARK OFFICE

CERTIFICATE OF CORRECTION

PATENT NO. : 4,684,173

DATED : August 4, 1987

INVENTOR(S) : HERMANN LOCHER

It is certified that error appears in the above-identified patent and that said Letters Patent is hereby corrected as shown below:

Column 3, line 11, after "DETAILED" please insert --DESCRIPTION--

Column 4, line 35, please delete "rearwardly" and insert --rearward--

Column 6, line 57, please delete "bring" and insert --being--

Column 6, line 60, please delete "resulting" and insert --reclining--.

Signed and Sealed this

Twenty-third Day of February, 1988

*Attest:*

DONALD J. QUIGG

*Attesting Officer*

*Commissioner of Patents and Trademarks*